US006615775B2

(12) United States Patent
Takemura et al.

(10) Patent No.: US 6,615,775 B2
(45) Date of Patent: Sep. 9, 2003

(54) VARIABLE VALVE OPERATING SYSTEM OF INTERNAL COMBUSTION ENGINE ENABLING VARIATION OF VALVE-LIFT CHARACTERISTIC AND PHASE

(75) Inventors: Shinichi Takemura, Yokohama (JP); Tsuneyasu Nohara, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/205,198

(22) Filed: Jul. 26, 2002

(65) Prior Publication Data

US 2003/0041823 A1 Mar. 6, 2003

(30) Foreign Application Priority Data

Aug. 29, 2001 (JP) ..... 2001-258913

(51) Int. Cl.[7] ..... F01L 1/34

(52) U.S. Cl. ..... 123/90.15; 123/90.16; 123/90.17; 123/90.27; 123/90.31

(58) Field of Search ..... 123/90.15, 90.16, 123/90.17, 90.18, 90.27, 90.31

(56) References Cited

U.S. PATENT DOCUMENTS 5,398,502 A * 3/1995 Watanabe ..... 60/284
5,988,125 A 11/1999 Hara et al.
6,397,800 B2 * 6/2002 Nohara et al. ..... 123/90.15
6,502,535 B2 * 1/2003 Nakamura ..... 123/90.15

FOREIGN PATENT DOCUMENTS

JP 02267308 A * 11/1990 ..... F01L/13/00
JP 11-107725 4/1999
JP 2000-220420 8/2000

* cited by examiner

*Primary Examiner*—Thomas Denion
*Assistant Examiner*—Ching Chang
(74) *Attorney, Agent, or Firm*—Foley & Lardner

(57) ABSTRACT

In an internal combustion engine employing a variable lift and working angle control mechanism and a variable phase control mechanism, a first sensor is provided to detect an actual control state of the variable lift and working angle control mechanism every sampling time intervals. Also provided is a second sensor that detects an actual control state of the variable phase control mechanism every sampling time intervals. At least one of the sampling time interval for the first sensor and the sampling time interval for the second sensor has a characteristic that the one sampling time interval varies relative to the engine speed. A rate of change in the sampling time interval for the first sensor with respect to the engine speed is different from a rate of change in the sampling time interval for the second sensor with respect to the engine speed.

15 Claims, 8 Drawing Sheets

FIG.3

| OPERATING CONDITIONS | VALVE OPERATING CHARACTERISTICS |
|---|---|
| ① AT IDLING (CONTAINING DURING VERY LOW LOAD AND MIDDLE OR HIGH SPEED OPERATIONS) | LIFT & WORKING ANGLE : VERY SMALL<br>PHASE : MAX. RETARDED<br> 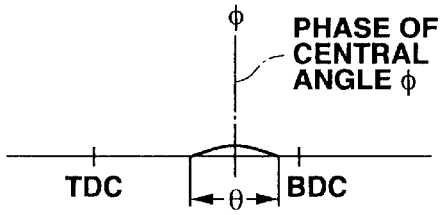 |
| ② DURING LOW LOAD OPERATION (CONTAINING DURING IDLING WITH ENGINE ACCESSORIES ACTUATED) | LIFT & WORKING ANGLE : VERY SMALL ~ SMALL<br>PHASE : ADVANCED<br> 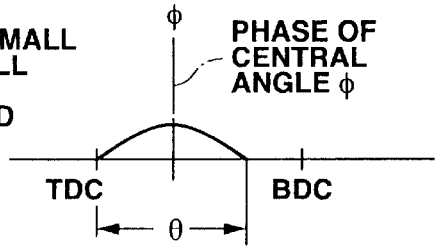 |
| ③ DURING MIDDLE LOAD OPERATION | LIFT & WORKING ANGLE : SMALL<br>PHASE : MAX. ADVANCED<br> 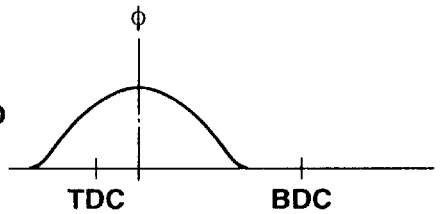 |
| ④ DURING HIGH LOAD LOW SPEED OPERATION | LIFT & WORKING ANGLE : SMALL ~ MIDDLE<br>PHASE : MAX. RETARDED / ADVANCED<br> 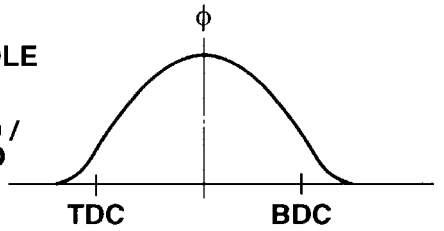 |
| ⑤ DURING HIGH LOAD MIDDLE SPEED OPERATION | LIFT & WORKING ANGLE : MIDDLE<br>PHASE : MAX. RETARDED / ADVANCED<br> 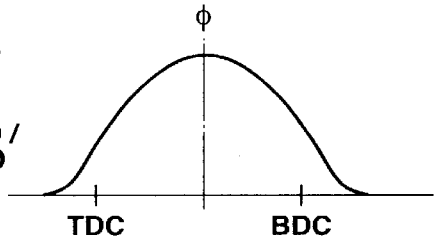 |
| ⑥ DURING HIGH LOAD HIGH SPEED OPERATION | LIFT & WORKING ANGLE : LARGE<br>PHASE : MAX. RETARDED / ADVANCED<br> 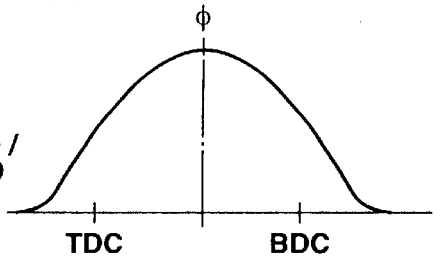 |

SELF-POSITION OF VARIABLE LIFT AND WORKING ANGLE CONTROL MECHANISM

SELF-POSITION OF VARIABLE PHASE CONTROL MECHANISM

VARIABLE VALVE OPERATING SYSTEM OF INTERNAL COMBUSTION ENGINE ENABLING VARIATION OF VALVE-LIFT CHARACTERISTIC AND PHASE

TECHNICAL FIELD

The present invention relates to a variable valve operating system of an internal combustion engine enabling valve-lift characteristic (valve lift and event) and phase to be varied, and in particular being capable of continuously simultaneously changing all of valve lift, working angle, and phase of intake and/or exhaust valves depending on engine operating conditions.

BACKGROUND ART

There have been proposed and developed various internal combustion engines equipped with a variable valve operating system enabling valve-lift characteristic (valve lift and lifted period) and phase to be varied depending on engine operating conditions, in order to reconcile both improved fuel economy and enhanced engine performance through all engine operating conditions. One such variable valve operating system with variable valve-lift characteristic and phase control device has been disclosed in Japanese Patent Provisional Publication No. 2000-220420 (hereinafter is referred to as JP2000-220420). The variable valve operating system disclosed in JP2000-220420 is comprised of a variable valve-lift characteristic mechanism (exactly, a two-stage valve-lift and working angle control mechanism) and a variable phase control mechanism. The two-stage valve-lift and working angle control mechanism is capable of changing from one of a large valve-lift characteristic and a small valve-lift characteristic to the other by switching an active cam from one of a high speed cam and a low speed cam to the other. On the other hand, the variable phase control mechanism is capable of advancing or retarding a phase of working angle. The two-stage valve-lift and working angle control mechanism and the variable phase control mechanism are hydraulically operated independently of each other by means of respective hydraulic actuators. Such two-stage switching between the small and large valve-lift characteristics cannot adequately cover a wide range of engine operating conditions. In case of the two-stage switching between only two valve-lift characteristics, it is impossible to vary a valve lift characteristic over a wide range of valve lift characteristics containing a small lift and working angle suited to reduced fuel consumption in steady-state driving, a somewhat large valve lift and working angle suited to improved engine performance at full throttle and low speed, and a large valve lift and working angle suited to improved engine performance at full throttle and high speed. In recent years, for high-precision engine control, there have been proposed and developed various variable valve operating systems enabling valve-lift characteristic (valve lift and working angle) to be continuously simultaneously varied depending on engine operating conditions. One such continuous variable valve-lift characteristic mechanism has been disclosed in Japanese Patent Provisional Publication No. 11-107725 (hereinafter is referred to as JP11-107725). The continuous variable valve-lift characteristic mechanism as disclosed in JP11-107725 is often combined with the previously-noted variable phase control mechanism so as to construct a continuous variable valve-lift characteristic and phase control system. In order to accurately and continuously control both the continuous variable valve-lift characteristic mechanism and the variable phase control mechanism combined with each other, three major components are employed with the continuous variable valve-lift characteristic and phase control system. These are (i) sensors that detect actual control states of the respective mechanisms, (ii) actuators for the two mechanisms, and (iii) an electronic controller or an electronic control unit (ECU) or an electronic control module (ECM) that controls each actuator so that the value of the controlled quantity for each mechanism is brought closer to a desired value.

SUMMARY OF THE INVENTION

Actually, sampling of the control state is executed every predetermined sampling time intervals. Assuming that the sampling time interval is fixed to a constant time length irrespective of engine speeds and additionally the fixed sampling time interval is suited to low engine speeds, there is an increased tendency for the controllability to be deteriorated during high-speed operation. If such a fixed sampling time interval suited to the low engine speeds is used for an internal combustion engine whose intake air quantity can be controlled by way of variable intake-valve lift characteristic control, the intake-air quantity control accuracy may be lowered, thus deteriorating combustion stability. In contrast to the above, assuming that the sampling time interval can be changed depending upon an engine speed so as to provide a sampling time interval suited to high engine speeds, for example, if the sampling time interval can be changed to a short sampling time interval suited to high engine speeds, there is a problem of a large control load on the continuous variable valve-lift characteristic and phase control system during high-speed operation.

Accordingly, it is an object of the invention to provide a variable valve operating system of an internal combustion engine enabling valve-lift characteristic and phase to be continuously varied, which avoids the aforementioned disadvantages.

In order to accomplish the aforementioned and other objects of the present invention, a variable valve operating system of an internal combustion engine comprises a variable lift and working angle control mechanism that enables both a lift and a working angle of an engine valve to be continuously simultaneously varied depending on engine operating conditions including at least an engine speed, a variable phase control mechanism that enables a phase at a maximum valve lift point of the engine valve to be varied depending on the engine operating conditions, a first sensor that detects an actual control state of the variable lift and working angle control mechanism every sampling time intervals, a second sensor that detects an actual control state of the variable phase control mechanism every sampling time intervals, at least one of the sampling time interval for the first sensor and the sampling time interval for the second sensor having a characteristic that the one sampling time interval varies relative to the engine speed, and a rate of change in the sampling time interval for the first sensor with respect to the engine speed being different from a rate of change in the sampling time interval for the second sensor with respect to the engine speed.

According to another aspect of the invention, an internal combustion engine comprises a variable lift and working angle control mechanism that enables both a lift and a working angle of an engine valve to be continuously simultaneously varied depending on engine operating conditions including at least an engine speed, a variable phase control mechanism that enables a phase at a maximum valve lift point of the engine valve to be varied depending on the engine operating conditions, engine sensors that detect the engine operating conditions, a first sensor that detects an actual control state of the variable lift and working angle control mechanism every sampling time intervals, a second sensor that detects an actual control state of the variable phase control mechanism every sampling time intervals, a first actuator that provides a motive power to the variable lift and working angle control mechanism, a second actuator that provides a motive power to the variable phase control mechanism, a control unit configured to be electronically connected to the engine sensors, the first and second sensors, and the first and second actuators, for feedback-controlling all of the lift, the working angle, and the phase of the engine valve depending on the engine operating conditions, the control unit comprising a data processor programmed to perform the following, (a) calculating a desired control state of the variable lift and working angle control mechanism and a desired control state of the variable phase control mechanism based on the engine operating conditions;

(b) calculating both a set value of a first sensor counter corresponding to the sampling time interval for the first sensor and a set value of a second sensor counter corresponding to the sampling time interval for the second sensor based on the engine speed;

(c) sampling the actual control state of the variable lift and working angle control mechanism each time the set value of the first sensor counter has expired;

(d) sampling the actual control state of the variable phase control mechanism each time the set value of the second sensor counter has expired;

(e) applying an error signal corresponding to a deviation of the actual control state of the variable lift and working angle control mechanism from the desired control state to the first actuator; and (f) applying an error signal corresponding to a deviation of the actual control state of the variable phase control mechanism from the desired control state to the second actuator;

a rate of change in the sampling time interval for the first sensor with respect to the engine speed being different from a rate of change in the sampling time interval for the second sensor with respect to the engine speed.

According to a further aspect of the invention, an internal combustion engine comprises a variable lift and working angle control means for enabling both a lift and a working angle of an engine valve to be continuously simultaneously varied depending on engine operating conditions including at least an engine speed, a variable phase control means for enabling a phase at a maximum valve lift point of the engine valve to be varied depending on the engine operating conditions, engine sensor for detecting the engine operating conditions, a first sensor for detecting an actual control state of the variable lift and working angle control means every sampling time intervals $T_{S1}$, a second sensor for detecting an actual control state of the variable phase control means every sampling time intervals, a first actuator for providing a motive power to the variable lift and working angle control means, a second actuator for providing a motive power to the variable phase control means, a control unit configured to be electronically connected to the engine sensors, the first and second sensors, and the first and second actuators, for feedback-controlling all of the lift, the working angle, and the phase of the engine valve depending on the engine operating conditions, the control unit comprising a data processor programmed to perform the following, (a) calculating a desired control state of the variable lift and working angle control means and a desired control state of the variable phase control means based on the engine operating conditions;

(b) calculating both a set value of a first sensor counter corresponding to the sampling time interval for the first sensor and a set value of a second sensor counter corresponding to the sampling time interval for the second sensor based on the engine speed;

(c) sampling the actual control state of the variable lift and working angle control means each time a count value of the first sensor counter reaches the set value;

(d) sampling the actual control state of the variable phase control means each time a count value of the second sensor counter reaches the set value;

(e) applying an error signal corresponding to a deviation of the actual control state of the variable lift and working angle control means from the desired control state to the first actuator;

(f) clearing the count value of the first sensor counter after application of the error signal to the first actuator;

(g) applying an error signal corresponding to a deviation of the actual control state of the variable phase control mechanism from the desired control state to the second actuator; and (h) clearing the count value of the second sensor counter after application of the error signal to the second actuator;

a rate of change in the sampling time interval for the first sensor with respect to the engine speed being different from a rate of change in the sampling time interval for the second sensor with respect to the engine speed.

The other objects and features of this invention will become understood from the following description with reference to the accompanying drawings.

BRIEF DESCRIPTION OF THE DRAWINGS

FIG. 3 is an explanatory view showing valve operating characteristics under various engine/vehicle operating conditions.

DESCRIPTION OF THE PREFERRED EMBODIMENTS

Figure 1:
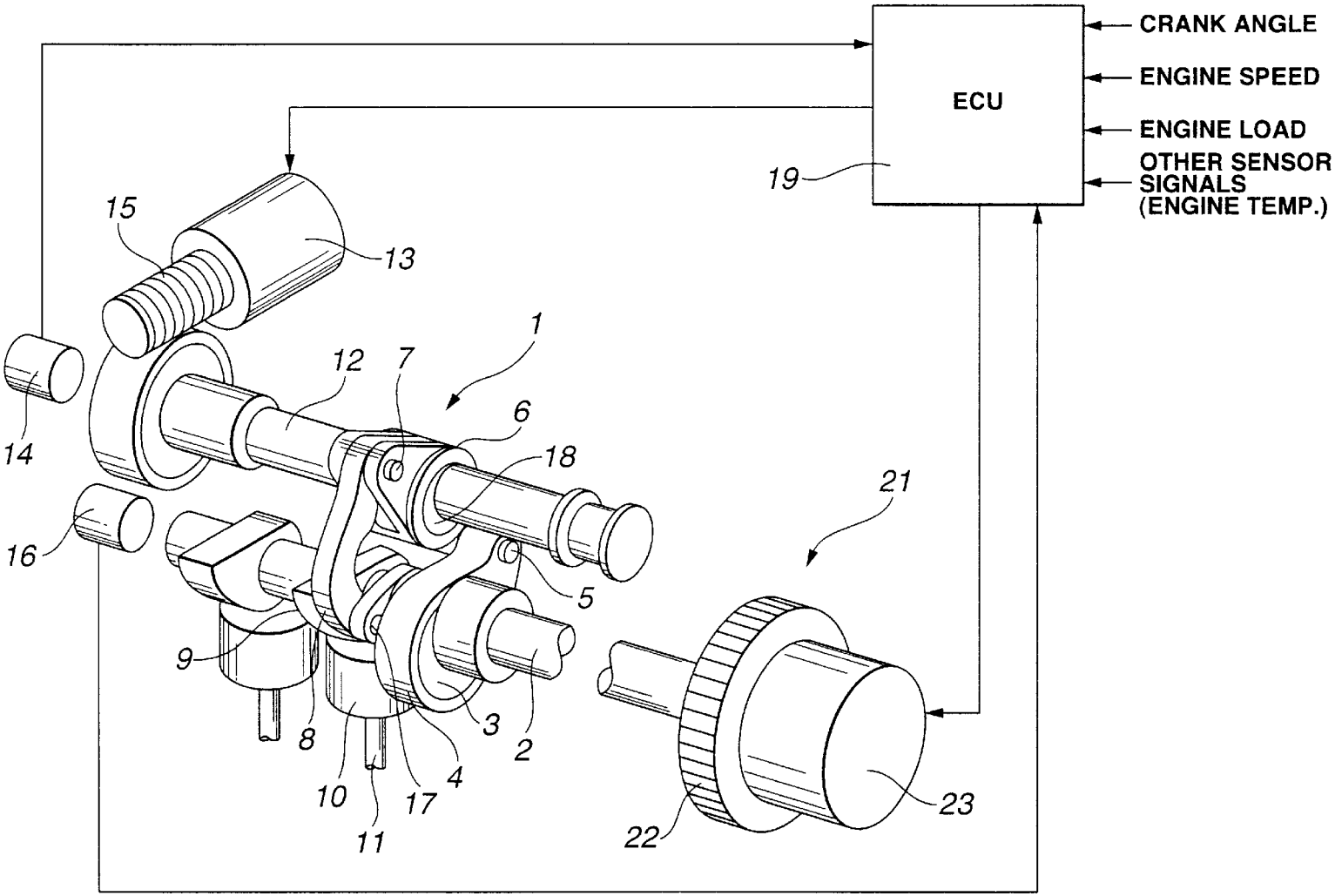
FIG. 1 is a perspective view illustrating a variable valve operating system (containing both a variable lift and working angle control mechanism and a variable phase control mechanism).

Referring now to the drawings, particularly to FIG. 1, the variable valve operating system of the invention is exemplified in an automotive spark-ignition gasoline engine. In the embodiment shown in FIG. 1, the variable valve operating system is applied to an intake-port valve of engine valves. As shown in FIG. 1, the variable valve operating system of the embodiment includes a variable lift and working angle control mechanism (or a variable valve-lift characteristic mechanism) 1 and a variable phase control mechanism 21 combined to each other. Variable lift and working angle control mechanism 1 enables the valve-lift characteristic (both the valve lift and working angle) to be continuously simultaneously varied depending on engine operating conditions. On the other hand, variable phase control mechanism 21 enables the phase of working angle (an angular phase at the maximum valve lift point often called "central angle") to be advanced or retarded depending on the engine operating conditions. Variable lift and working angle control mechanism 1 incorporated in the variable valve operating system of the embodiment is similar to a variable valve actuation apparatus such as disclosed in U.S. Pat. No. 5,988,125 (corresponding to JP11-107725), issued Nov. 23, 1999 to Hara et al, the teachings of which are hereby incorporated by reference. The construction of variable lift and working angle control mechanism 1 is briefly described hereunder. Variable lift and working angle control mechanism 1 is comprised of an intake valve 11 slidably supported on a cylinder head (not shown), a drive shaft 2, a first eccentric cam 3, a control shaft 12, a second eccentric cam 18, a rocker arm 6, a rockable cam 9, a link arm 4, and a link member 8. Drive shaft 2 is rotatably supported by a cam bracket (not shown), which is located on the upper portion of the cylinder head. First eccentric cam 3 is fixedly connected to the outer periphery of drive shaft 2 by way of press-fitting. Control shaft 12 is rotatably supported by the same cam bracket and located parallel to drive shaft 2. Second eccentric cam 18 is fixedly connected to or integrally formed with control shaft 12. Rocker arm 6 is rockably supported on the outer periphery of second eccentric cam 18 of control shaft 12. Rockable cam 9 is rotatably fitted on the outer periphery of drive shaft 2 in such a manner as to directly push an intake-valve tappet 10, which has a cylindrical bore closed at its upper end and provided at the valve stem end of intake valve 11. Link arm 4 serves to mechanically link first eccentric cam 3 to rocker arm 6. On the other hand, link member 8 serves to mechanically link rocker arm 6 to rockable cam 9. Drive shaft 2 is driven by an engine crankshaft (not shown) via a timing chain or a timing belt, such that drive shaft 2 rotates about its axis in synchronism with rotation of the crankshaft. First eccentric cam 3 is cylindrical in shape. The central axis of the cylindrical outer peripheral surface of first eccentric cam 3 is eccentric to the axis of drive shaft 2 by a predetermined eccentricity. A substantially annular portion of link arm 4 is rotatably fitted onto the cylindrical outer peripheral surface of first eccentric cam 3. Rocker arm 6 is oscillatingly supported at its substantially annular central portion by second eccentric cam 18 of control shaft 12. A protruded portion of link arm 4 is linked to one end of rocker arm 6 by means of a first connecting pin 5. The upper end of link member 8 is linked to the other end of rocker arm 6 by means of a second connecting pin 7. The axis of second eccentric cam 18 is eccentric to the axis of control shaft 12, and therefore the center of oscillating motion of rocker arm 6 can be varied by changing the angular position of control shaft 12. Rockable cam 9 is rotatably fitted onto the outer periphery of drive shaft 2. One end portion of rockable cam 9 is linked to link member 8 by means of a third connecting pin 17. With the linkage structure discussed above, rotary motion of drive shaft 2 is converted into oscillating motion of rockable cam 9. Rockable cam 9 is formed on its lower surface with a base-circle surface portion being concentric to drive shaft 2 and a moderately-curved cam surface being continuous with the base-circle surface portion and extending toward the other end of rockable cam 9. The base-circle surface portion and the cam surface portion of rockable cam 9 are designed to be brought into abutted-contact (sliding-contact) with a designated point or a designated position of the upper surface of the associated intake-valve tappet 10, depending on an angular position of rockable cam 9 oscillating. That is, the base-circle surface portion functions as a base-circle section with in which a valve lift is zero. A predetermined angular range of the cam surface portion being continuous with the base-circle surface portion functions as a ramp section. A predetermined angular range of a cam nose portion of the cam surface portion that is continuous with the ramp section, functions as a lift section. As clearly shown in FIG. 1, control shaft 12 of variable lift and working angle control mechanism 1 is driven within a predetermined angular range by means of a lift and working angle control actuator 13. In the shown embodiment, lift and working angle control actuator 13 is comprised of a geared servomotor equipped with a warm gear 15 and a warm wheel (not numbered) that is fixedly connected to control shaft 12. The servomotor of lift and working angle control actuator 13 is electronically controlled in response to a control signal from an electronic engine control unit (ECU) 19. In the system of the embodiment, the rotation angle or angular position of control shaft 12, that is, the actual control state of variable lift and working angle control mechanism 1 is detected by means of a control shaft sensor 14 (hereinafter is referred to as "first sensor"). Lift and working angle control actuator 13 is closed-loop controlled or feedback-controlled based on the actual control state of variable lift and working angle control mechanism 1, detected by first sensor 14, and a comparison with the desired value (the desired output). Variable lift and working angle control mechanism 1 operates as follows.

During rotation of drive shaft 2, link arm 4 moves up and down by virtue of cam action of first eccentric cam 3. The up-and-down motion of link arm 4 causes oscillating motion of rocker arm 6. The oscillating motion of rocker arm 6 is transmitted via link member 8 to rockable cam 9, and thus rockable cam 9 oscillates. By virtue of cam action of rockable cam 9 oscillating, intake-valve tappet 10 is pushed and therefore intake valve 11 lifts. If the angular position of control shaft 12 is varied by means of actuator 13, an initial position of rocker arm 6 varies and as a result an initial position (or a starting point) of the oscillating motion of rockable cam 9 varies. Assuming that the angular position of second eccentric cam 18 is shifted from a first angular position that the axis of second eccentric cam 18 is located just under the axis of control shaft 12 to a second angular position that the axis of second eccentric cam 18 is located just above the axis of control shaft 12, as a whole rocker arm 6 shifts upwards. As a result, the initial position (the starting point) of rockable cam 9 is displaced or shifted so that the rockable cam itself is inclined in a direction that the cam surface portion of rockable cam 9 moves apart from intake-valve tappet 10. With rocker arm 6 shifted upwards, when rockable cam 9 oscillates during rotation of drive shaft 2, the base-circle surface portion is held in contact with intake-valve tappet 10 for a comparatively long time period. In other words, a time period within which the cam surface portion is held in contact with intake-valve tappet 10 becomes short. As a consequence, a valve lift becomes small. Additionally, a lifted period (i.e., a working angle θ) from intake-valve open timing IVO to intake-valve closure timing IVC becomes reduced.

Conversely when the angular position of second eccentric cam 18 is shifted from the second angular position that the axis of second eccentric cam 18 is located just above the axis of control shaft 12 to the first angular position that the axis of second eccentric cam 18 is located just under the axis of control shaft 12, as a whole rocker arm 6 shifts downwards. As a result, the initial position (the starting point) of rockable cam 9 is displaced or shifted so that the rockable cam itself is inclined in a direction that the cam surface portion of rockable cam 9 moves towards intake-valve tappet 10. With rocker arm 6 shifted downwards, when rockable cam 9 oscillates during rotation of drive shaft 2, a portion that is brought into contact with intake-valve tappet 10 is somewhat shifted from the base-circle surface portion to the cam surface portion. As a consequence, a valve lift becomes large. Additionally, a lifted period (i.e., a working angle θ) from intake-valve open timing IVO to intake-valve closure timing IVC becomes extended. The angular position of second eccentric cam 18 can be continuously varied within predetermined limits by means of actuator 13, and thus valve lift characteristics (valve lift and working angle) also vary continuously, so that variable lift and working angle control mechanism 1 can scale up and down both the valve lift and the working angle continuously simultaneously. For instance, as can be seen from lower three valve-lift characteristic curves ④, ⑤, and ⑥, shown in FIG. 3, obtained at full throttle and low speed, at full throttle and middle speed, and at full throttle and high speed, in the variable lift and working angle control mechanism 1 incorporated in the variable valve operating system of the embodiment, intake-valve open timing IVO and intake-valve closure timing IVC vary symmetrically with each other, in accordance with a change in valve lift and a change in working angle.

Referring again to FIG. 1, there is shown one example of variable phase control mechanism 21. In the shown embodiment, variable phase control mechanism 21 includes a sprocket 22 located at the front end of drive shaft 2, and a phase control actuator 23 that enables relative rotation of drive shaft 2 to sprocket 22 within predetermined limits. For power transmission from the crankshaft to the intake-valve drive shaft, a timing belt (not shown) or a timing chain (not shown) is wrapped around sprocket 22 and a crank pulley (not shown) fixedly connected to one end of the crankshaft. The timing belt drive or timing-chain drive permits intake-valve drive shaft 2 to rotate in synchronism with rotation of the crankshaft. A hydraulically-operated rotary type actuator or an electromagnetically-operated rotary type actuator is generally used as a phase control actuator that variably continuously changes a phase of central angle ϕ of the working angle of intake valve 11. Phase control actuator 23 is electronically controlled in response to a control signal from ECU 19. The relative rotation of drive shaft 2 to sprocket 22 in one rotational direction results in a phase advance at the maximum intake-valve lift point (at central angle ϕ). Conversely, the relative rotation of drive shaft 2 to sprocket 22 in the opposite rotational direction results in a phase retard at the maximum intake-valve lift point. Only the phase of working angle (i.e., the angular phase at central angle ϕ) is advanced or retarded, with no valve-lift change and no working-angle change. The relative angular position of drive shaft 2 to sprocket 22 can be continuously varied within predetermined limits by means of phase control actuator 23, and thus the angular phase at central angle ϕ also varies continuously. In the system of the embodiment, the relative angular position of drive shaft 2 to sprocket 22 or the relative phase of drive shaft 2 to the crankshaft, that is, the actual control state of variable phase control mechanism 21 is detected by means of a drive shaft sensor 16 (hereinafter is referred to as "second sensors"). Phase control actuator 23 is closed-loop controlled or feedback-controlled based on the actual control state of variable phase control mechanism 21, detected by second sensor 16, and a comparison with the desired value (the desired output).

In the internal combustion engine of the embodiment employing the previously-discussed variable valve operating system at the intake valve side, it is possible to properly control the amount of air drawn into the engine by variably adjusting the valve operating characteristics for intake valve 11, independent of throttle opening control. Practically, it is preferable that a slight vacuum exists in an induction system for the purpose of recirculation of blow-by fumes. For this reason, instead of using a throttle valve, it is desirable to provide a throttling mechanism or a flow-constricting mechanism upstream of an air intake passage of the induction system to create a vacuum.

Figure 2:
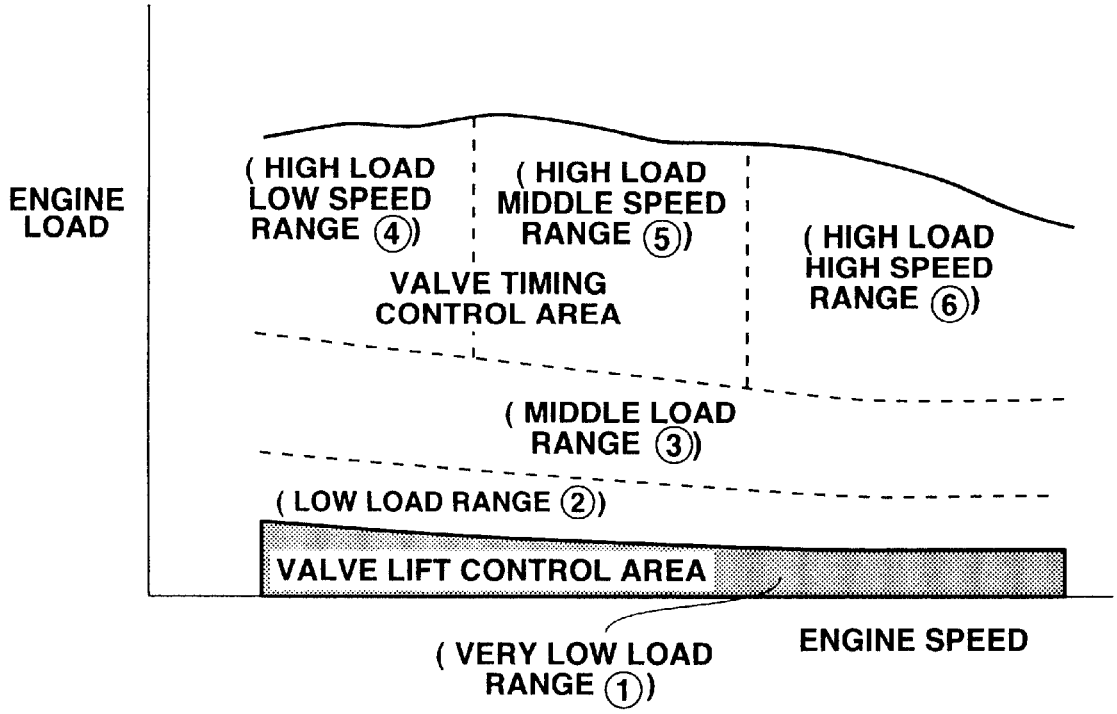
FIG. 2 is a characteristic map showing both a valve lift control area and a valve timing control area.

Details of the variable valve-lift characteristic control and variable phase control executed by the system of the embodiment, utilizing the variable lift and working angle control and the variable phase control are hereunder described in reference to FIGS. 2 and 3.

Referring now to FIG. 2, there is shown the control characteristic map showing how the valve lift control area and the valve timing control area have to be varied relative to engine speed and engine load. Of various engine/vehicle operating conditions, that is, during idling ① (containing during very low load and middle or high speed operations), during low load operation ② (containing during idling with engine accessories actuated), during middle load operation ③, during high load low speed operation ④, during high load middle speed operation ⑤, and during high load and high speed operation ⑥, the operating conditions ②, ③, ④, ⑤, and ⑥ are included in the valve timing control area. On the other hand, only the operating condition ① is included in the valve lift control area. Within the valve lift control area, that is, during idling ① (containing during very low load and middle or high speed operations), the intake air quantity is controlled, aiming mainly at the valve lift control for intake valve 11. In contrast, within the valve timing control area, that is, under the operating conditions ②, ③, ④, ⑤, and ⑥, the intake air quantity is controlled, aiming mainly at the valve timing control, in particular the IVC control.

Referring now to FIG. 3, there is shown the intake valve operating characteristics (a lift and a working angle θ, and a phase of working angle, i.e., an angular phase at a central angle ϕ) under various engine/vehicle operating conditions ①, ②, ③, ④, ⑤, and ⑥. As can be appreciated from the valve operating characteristics of FIG. 3, at idling (containing during very low load and middle or high speed operations) ①, the valve lift of intake valve 11 is adjusted or controlled to such a very small lift amount that the intake air quantity is unaffected by a change in the angular phase at central angle ϕ. Working angle θ is also adjusted to a very small working angle. On the other hand, the phase of central angle ϕ is kept at a maximum phase-retarded timing value, and thus the intake valve closure timing IVC is adjusted to a given timing value just before BDC. Owing to the use of the very small valve lift at idling (containing during very low load and middle or high speed operations) ①, intake air flow is suitably throttled or choked by way of a slight aperture defined between the valve seating face of intake valve 11 and the valve-seat face. This ensures a stable very small intake-air flow rate required in the very low load operating range ①. Additionally, the IVC is adjusted to the given timing value just before BDC, and therefore an effective compression ratio (generally defined as a ratio of the effective cylinder volume corresponding to the maximum working medium volume to the effective clearance volume corresponding to the minimum working medium volume) becomes a sufficiently high value. Enhanced gases flow, arising from the use of the very small valve lift at idling, and high effective compression ratio contribute to good combustion.

In the low load operating range ② containing during idling with engine accessories actuated, the valve lift and working angle θ are adjusted to greater values than those used under the very low operating range ①. On the other hand, the phase of central angle ϕ is somewhat advanced as compared to the very low operating range ①. That is, in the low load operating range ②, the intake air quantity control is performed by way of the variable phase control combined with the variable lift and working-angle control. By phase-advancing the IVC, the intake air quantity can be controlled to a comparatively small quantity. As a result of this, the valve lift and working angle θ of intake valve 11 are somewhat increased, thus reducing the pumping loss.

As discussed above, there is a less change in the intake air quantity occurring owing to a phase change in central angle ϕ in the very low load operating range ①, such as at idling. Thus, when switching from the very low load range ① to low load range ②, it is necessary to execute the variable lift and working-angle control (enlargement of the valve lift and working angle) rather than the variable phase control. In the same manner, during idling with engine accessories actuated, for example with an air-conditioning compressor activated, the variable lift and working-angle control takes priority over the variable phase control.

In the middle load operating range ③, that the engine load further increases and combustion is more stable than the low load operating range ②, the valve lift and working angle θ are adjusted to greater values than those used under the low operating range ②. On the other hand, the phase of central angle ϕ is further advanced as compared to the low operating range ②. At a certain engine load within the middle load operating range ③, a maximum phase-advanced timing value for the phase of central angle ϕ can be obtained. This allows a more complete utilization of internal EGR (exhaust gas or combustion gas recirculated from the exhaust port through the engine cylinder back to the intake port side). Therefore, it is possible to more effectively reduce the pumping loss.

In the high load operating range, that is, under high load low speed operation ④, under high load middle speed operation ⑤, and under high load and high speed operation ⑥, the valve lift and working angle θ are adjusted to greater values than those used under the middle operating range ③. Additionally, in order to attain suitable intake valve timing, variable phase control mechanism 21 is controlled. As clearly shown in FIG. 3, the valve lift and working angle θ are further increased or enlarged from high load low speed operating range ④, via high load middle speed operating range ⑤, to high load and high speed operating range ⑥. On the other hand, the phase of central angle ϕ is adjusted to the maximum phase-retarded timing value or a phase-advanced timing value, depending upon the throttle opening or the accelerator opening.

According to the intake air quantity control as discussed above, in very low load operating range ① such as at idling, as the valve lift control area, the stable very small air flow rate control is achieved mainly by way of the valve lift control for intake valve 11. Engine loads that are on a border between the valve lift control area and the valve timing control area, in other words, a switching point between very low load operating range ① and low load operating range ② can be varied or compensated for depending on a state of combustion of the engine, that is, a combustion stability. To realize more simple control procedures, the switching point between very low load operating range ①and low load operating range ② may be varied or compensated for depending on engine temperature detected, such as engine coolant temperature or engine oil temperature. Such compensation for the switching point between very low load operating range ① and low load operating range ② enables the valve timing control area to enlarge without deteriorating the combustion stability of the engine, thereby ensuring the reduced pumping loss.

As discussed above, the two different variable mechanisms 1 and 21 are electronically controlled in response to respective control signals from ECU 19. Electronic engine control unit 19 generally comprises a microcomputer. ECU 19 includes an input/output interface (I/O), memories (RAM, ROM), and a microprocessor or a central processing unit (CPU). The input/output interface (I/O) of ECU 19 receives input information from various engine/vehicle sensors, namely a crank angle sensor or a crank position sensor (an engine speed sensor), a throttle-opening sensor, an exhaust-temperature sensor, an engine vacuum sensor, an engine temperature sensor, an engine oil temperature sensor, an accelerator-opening sensor (an engine load sensor), a vehicle speed sensor and the like. Instead of using the accelerator opening or the throttle opening as engine-load indicative data, negative pressure in an intake pipe or intake manifold vacuum or a quantity of intake air or a fuel-injection amount maybe used as engine load parameters. In the shown embodiment, the accelerator opening is used as engine-load indicative data. Within ECU 19, the central processing unit (CPU) allows the access by the I/O interface of input informational data signals from the previously-discussed engine/vehicle sensors. The CPU of ECU 19 is responsible for carrying an electronic ignition timing control program for an ignition timing advance control system and an electronic fuel injection control program related to fuel injection amount control and fuel injection timing control, and also responsible for carrying a predetermined control program (see FIG. 4) containing both variable intake-valve lift and working-angle control and variable intake-valve central angle ϕ control (variable intake-valve phase control), stored in memories, and is capable of performing necessary arithmetic and logic operations. Computational results (arithmetic calculation results), that is, calculated output signals (drive currents) are relayed via the output interface circuitry of the ECU to output stages, namely lift and working angle control actuator 13 and phase control actuator 23.

Figure 4:
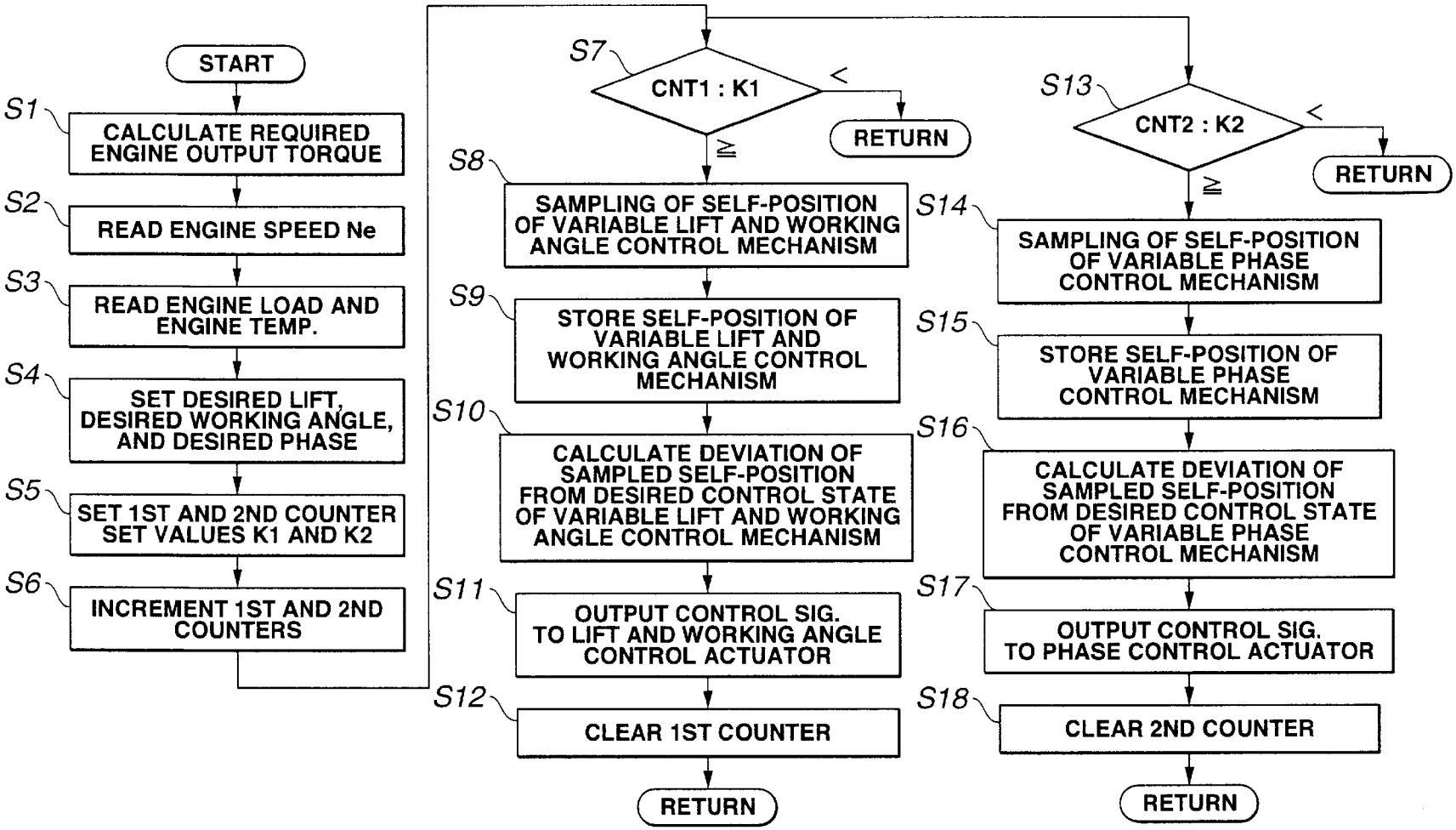
FIG. 4 is a flow chart illustrating a control routine executed by the variable valve operating system of the embodiment.

Referring now to FIG. 4, there is shown the control program executed by the variable valve operating system of the embodiment. The routine shown in FIG. 4 is executed by means of ECU 19 as time-triggered interrupt routines to be triggered every predetermined time intervals.

At step S1, a required engine output torque is calculated based on input information from the accelerator opening sensor and the vehicle speed sensor.

At step S2, engine speed Ne is read.

At step S3, engine load and engine temperature are read.

At step S4, a desired valve-lift characteristic (that is, a desired valve lift and a desired working angle) and a desired phase of central angle $\phi$ of the working angle of intake valve 11 are set or calculated based on a specific engine/vehicle operating condition computed or estimated through steps S1–S3.

At step S5, a set value K1 of a first sensor counter (simply, a first counter) associated with first sensor 14 that detects the control state of variable lift and working angle control mechanism 1 and a set value K2 of a second sensor counter (simply, a second counter) associated with second sensor 16 that detects the control state of variable phase control mechanism 21 are set or calculating based on the latest up-to-date information data signal (indicative of the current engine speed Ne) being received from the crank angle sensor. Note that first counter set value K1 corresponds to a sampling time interval $T_{S1}$ for first sensor 14 and second counter set value K2 corresponds to a sampling time interval $T_{S2}$ for second sensor 16. After first and second counter set values K1 and K2 are set through a series of steps S1–S5, step S6 occurs.

At step S6, the first and second counters are incremented by "1". After step S6, a first group of steps S7–S12 and a second group of steps S13–S18 are executed in parallel with each other.

At step S7, a check is made to determine whether a count value CNT1 of the first counter is compared to first counter set value K1. When count value CNT1 of the first counter is less than set value K1, that is, when CNT1<K1, the current control routine terminates. Conversely when count value CNT1 of the first counter is greater than or equal to set value K1, that is, when CNT1≧K1, step S8 occurs. The condition defined by the inequality CNT1≧K1 means that the predetermined sampling time interval $T_{S1}$ for first sensor 14 has expired. That is, a transition point from CNT1<K1 to CNT1≧K1 means a point of sampling of the control state of variable lift and working angle control mechanism 1. In other words, at the time point shifting from CNT1<K1 to CNT1≧K1, sampling of the control state of variable lift and working angle control mechanism 1 is time-triggered.

At step S8, the current control state (the current control position) of variable lift and working angle control mechanism 1, that is, the current angular position of control shaft 12 or a so-called self-position of variable lift and working angle control mechanism 1 is detected or sampled based on the output signal from first sensor 14.

At step S9, the self-position of variable lift and working angle control mechanism 1, which is sampled at step S8, is stored in a predetermined memory address.

At step S10, a deviation of the sampled self-position from a desired control state corresponding to the desired valve-lift characteristic of variable lift and working angle control mechanism 1, is calculated. At the same time, a controlled variable for variable lift and working angle control mechanism 1 is computed based on the deviation.

At step S11, ECU 19 outputs a control signal (a drive signal) via its output interface to lift and working-angle control actuator 13, so that the deviation of the sampled self-position from the desired control state of variable lift and working angle control mechanism 1 is continually reduced.

At step S12, the first counter is cleared to zero.

The second group of steps S13–S18 are similar to the first group of steps S7–S12.

At step S13, a check is made to determine whether a count value CNT2 of the second counter is compared to second counter set value K2. When count value CNT2 of the second counter is less than set value K2, that is, when CNT2<K2, the current control routine terminates. Conversely when count value CNT2 of the second counter is greater than or equal to set value K2, that is, when CNT2≧K2, step S14 occurs. The condition defined by the inequality CNT2≧K2 means that the predetermined sampling time interval $T_{S2}$ for second sensor 16 has expired. That is, a transition point from CNT2<K2 to CNT2≧K2 means a point of sampling of the control state of variable phase control mechanism 21. In other words, at the time point shifting from CNT2<K2 to CNT2≧K2, sampling of the control state of variable phase control mechanism 21 is time-triggered.

At step S14, the current control state (the current control position) of variable phase control mechanism 21, that is, the current relative phase of drive shaft 2 to the engine crankshaft or a so-called self-position of variable phase control mechanism 21 is detected or sampled based on the output signal from second sensor 16.

At step S15, the self-position of variable phase control mechanism 21, which is sampled at step S14, is stored in a predetermined memory address.

At step S16, a deviation of the sampled self-position from a desired control state corresponding to the desired phase of variable phase control mechanism 21, is calculated. At the same time, a controlled variable for variable phase control mechanism 21 is computed based on the deviation.

At step S17, ECU 19 outputs a control signal (a drive signal) via its output interface to phase control actuator 23, so that the deviation of the sampled self-position from the desired control state of variable phase control mechanism 21 is continually reduced.

At step S18, the second counter is cleared to zero.

Figure 5A:
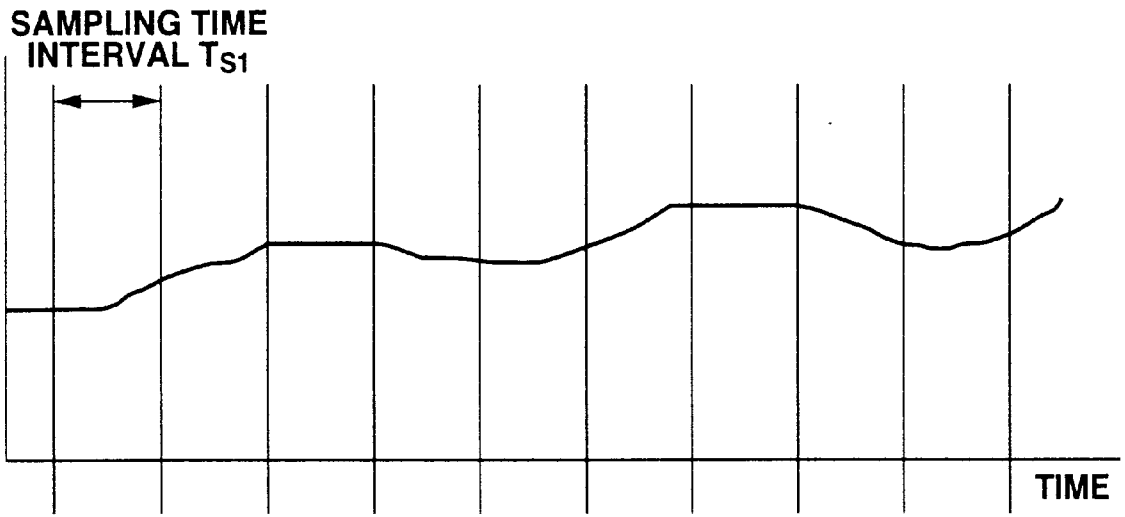
FIG. 5A is a time chart illustrating a change in control position of the variable lift and working angle control mechanism for every sampling time intervals $T_{S1}$.
Figure 5B:
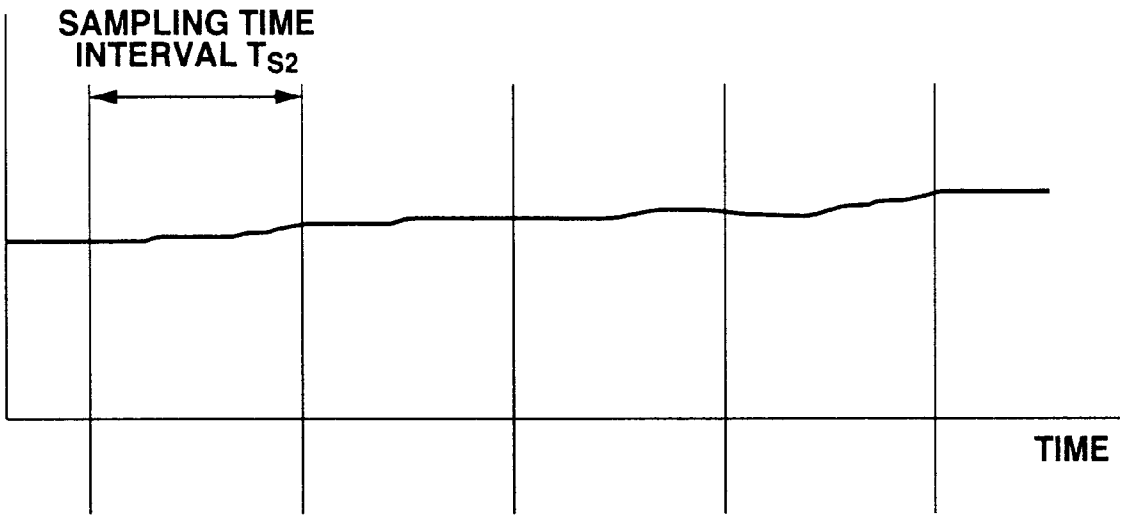
FIG. 5B is a time chart illustrating a change in control position of the variable phase control mechanism for every sampling time intervals $T_{S2}$.

Referring now to FIGS. 5A and 5B, there are shown a change in self-position of variable lift and working angle control mechanism 1 for every sampling time intervals $T_{S1}$ and a change in self-position of variable phase control mechanism 21 for every sampling time intervals $T_{S2}$. As set forth above, sampling time interval $T_{S1}$ corresponds to first counter set value K1, whereas sampling time interval $T_{S2}$ corresponds to second counter set value K2. In case of the example of sampling time intervals $T_{S1}$ and $T_{S2}$ shown in FIGS. 5A and 5B, first sampling time interval $T_{S1}$ for variable lift and working angle control mechanism 1 (for first sensor 14) is set to be shorter than second sampling time interval $T_{S2}$ for variable phase control mechanism 21 (for second sensor 16).

Figure 6:
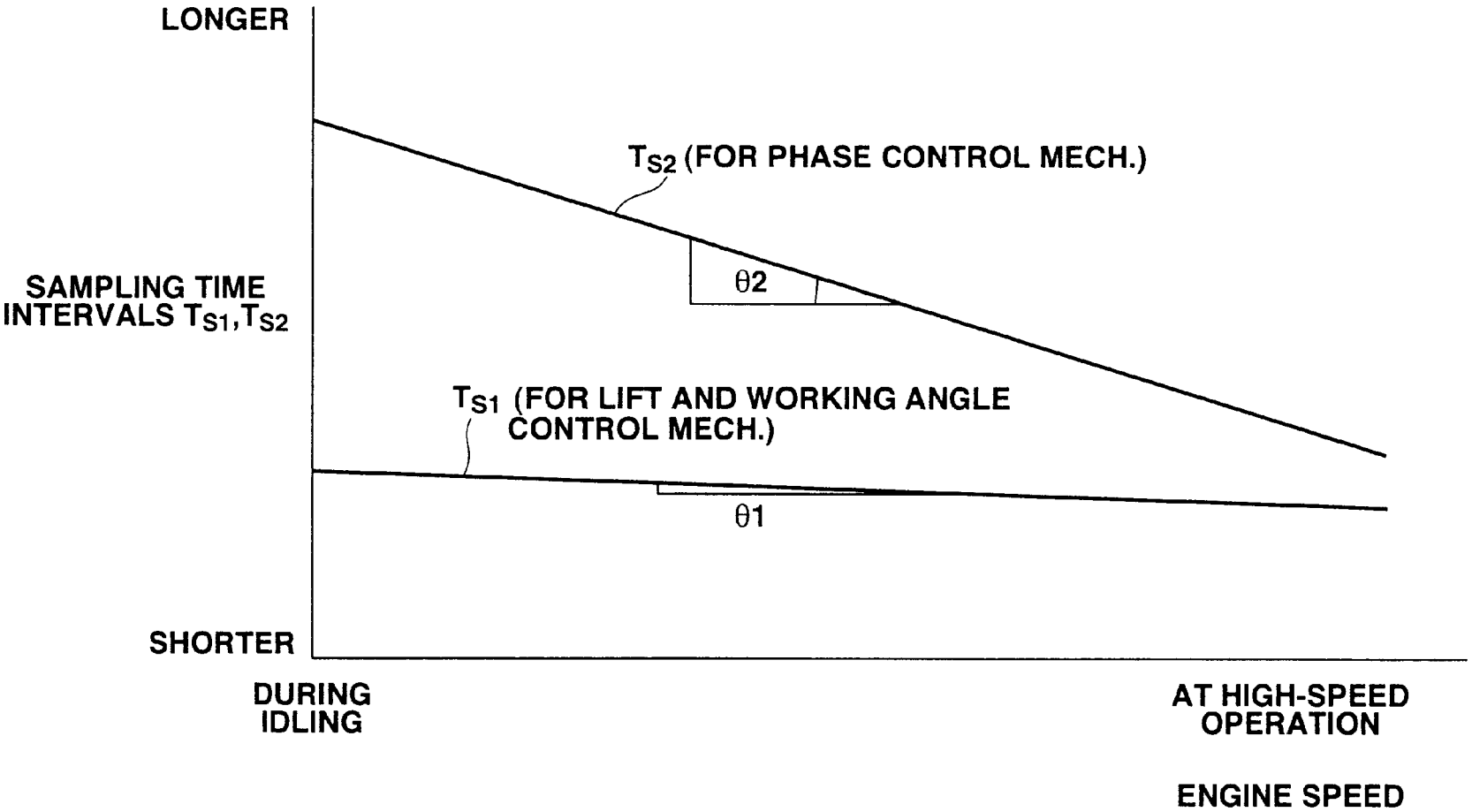
FIG. 6 is a first characteristic map showing an engine speed Ne versus sampling time interval $T_{S1}$ characteristic and an engine speed Ne versus sampling time interval $T_{S2}$ characteristic.

Referring now to FIG. 6, there is shown the first characteristic map showing how first and second sampling time intervals $T_{S1}$ and $T_{S2}$ vary relative to engine speed Ne. As previously discussed by reference to step S4 of FIG. 4, first and second sampling time intervals $T_{S1}$ and $T_{S2}$, i.e., first and second counter set values K1 and K2 vary depending on engine speed Ne. In the first characteristic map shown in FIG. 6, there are the following three features.

(i) First sampling time interval $T_{S1}$ of variable lift and working angle control mechanism 1 is set to be shorter than second sampling time interval $T_{S2}$ of variable phase control mechanism 21 through all engine speeds.

(ii) First sampling time interval $T_{S1}$ tends to reduce in a linear fashion as engine speed Ne increases, and additionally a rate of change in first sampling time interval $T_{S1}$ in the sampling-time decreasing direction, that is, a decreasing rate $\theta 1$ of first sampling time interval $T_{S1}$ with respect to engine speed Ne is comparatively small.

(iii) Second sampling time interval $T_{S2}$ tends to reduce in a linear fashion as engine speed Ne increases, and additionally a rate of change in second sampling time interval $T_{S2}$ in the sampling-time decreasing direction, that is, a decreasing rate θ2 of second sampling time interval $T_{S2}$ with respect to engine speed Ne is relatively larger than the decreasing rate θ1 of first sampling time interval $T_{S1}$ with respect to engine speed Ne.

As discussed previously by reference to the intake valve operating characteristics of FIG. 3, in a low-speed range, the valve lift and working angle of intake valve 11 are both controlled to comparatively small values. On the assumption that there is the same control error (or the same deterioration in the control accuracy) in the variable valve lift and working angle control system in both modes, namely a small valve-lift characteristic mode suited to the low-speed range and a large valve-lift characteristic mode suited to the high-speed range, the intake-air-quantity control accuracy tends to be greatly affected during low-speed operation (in other words, in the small valve-lift characteristic mode) rather than during high-speed operation (in other words, in the large valve-lift characteristic mode). Therefore, during the low-speed operation, in order to enhance the control accuracy, first sampling time interval $T_{S1}$ has to be shortened or decreased. An actual time or real time for the same working angle at high-speed operation tends to be shorter than that at low-speed operation, and thus first sampling time interval $T_{S1}$ has to be shortened or decreased during high-speed operation as well as during low-speed operation. As a consequence, it is unnecessary to remarkably change first sampling time interval $T_{S1}$ through all engine speeds. For the reasons set forth above, according to the first characteristic map of FIG. 6, as can be seen from the engine speed Ne versus sampling time interval $T_{S1}$ characteristic, first sampling time interval $T_{S1}$ is merely decreasingly corrected by a slight decreasing rate θ1 of first sampling time interval $T_{S1}$ with respect to engine speed Ne.

Regarding variable phase control mechanism 21 that enables only the phase of working angle of intake valve 11 to be changed with no valve-lift change and no working-angle change, there is an increased tendency for the intake-air-quantity control accuracy to be hardly affected by a control error in the variable phase control system. Thus, it is possible to basically lengthen or increase second sampling time interval $T_{S2}$. However, when a great control error takes place in the variable phase control system during the valve overlap during which open periods of intake and exhaust valves are overlapped, there is a possibility of the undesired interference between intake valve 11 and the reciprocating piston. For the same valve overlap, the possibility of undesired interference between intake valve 11 and the piston in a small valve-lift characteristic mode suited to the low-speed range tends to be lower than that in a large valve-lift characteristic mode suited to the high-speed range. To avoid the undesired interference between intake valve 11 and the reciprocating piston, there is a less need to enhance the control accuracy during the variable phase control. Therefore, during low-speed operation it is possible to lengthen or increase second sampling time interval $T_{S2}$. In contrast, at high-speed operation, a large valve-lift characteristic is required. Thus, thoroughly taking into account a higher control accuracy required to avoid the undesired interference between intake valve 11 and the reciprocating piston, it is necessary to shorten or decrease second sampling time interval $T_{S2}$ during high-speed operation. For the reasons discussed above, as can be seen from the engine speed Ne versus sampling time interval $T_{S2}$ characteristic of the first characteristic map of FIG. 6, second sampling time interval $T_{S2}$ is remarkably decreasingly compensated for in accordance with an increase in engine speed Ne.

As discussed above, both of first and second sampling time intervals $T_{S1}$ and $T_{S2}$ are properly adjusted or compensated for such that, on the one hand, second sampling time interval $T_{S2}$ of variable phase control mechanism 21 is adjusted to an adequately shorter time period in the high-speed range, and, on the other hand, that a change in first sampling time interval $T_{S1}$ of variable lift and working angle control mechanism 1 is slight even when shifting from the low-speed range to the high-speed range. Therefore, an increase in the control load on the continuous variable valve-lift characteristic and phase control system during high-speed operation can be reduced to the minimum. Additionally, at low-speed operation, first sampling time interval $T_{S1}$ of variable lift and working angle control mechanism 1 is set to be shorter than second sampling time interval $T_{S2}$ of variable phase control mechanism 21. Owing to first sampling time interval $T_{S1}$ shorter than second sampling time interval $T_{S2}$ (i.e., $T_{S1}<T_{S2}$), the control accuracy of variable lift and working angle control mechanism 1 that the intake-air-quantity control accuracy tends to be greatly affected by an control error, can be assured preferentially rather than the control accuracy of variable phase control mechanism 21. Thus, it is possible to satisfy a required control accuracy for the intake air quantity control, while suppressing an undesired increase in the control load on the continuous variable valve-lift characteristic and phase control system.

Figure 7:
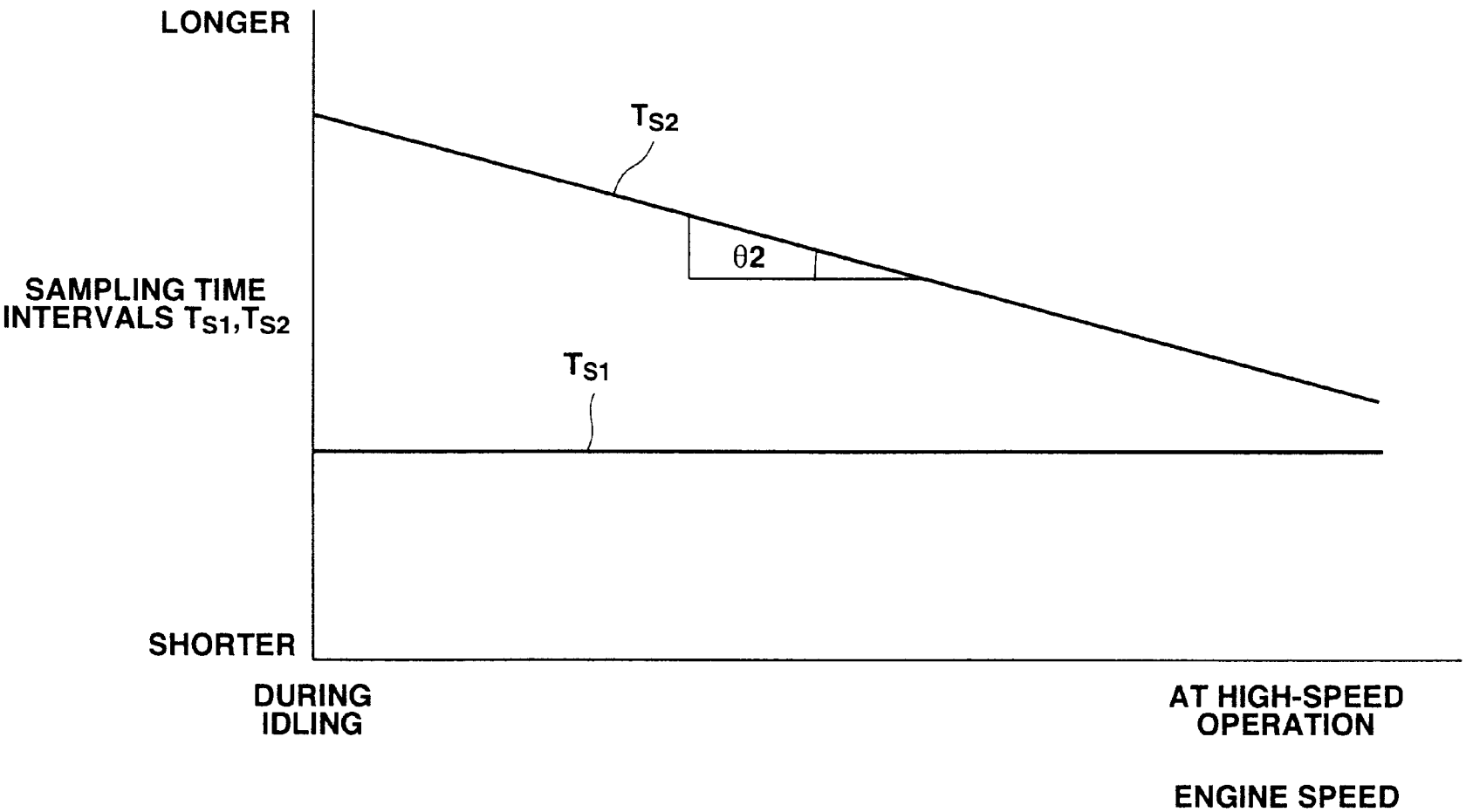
FIG. 7 is a second characteristic map showing the relationship among engine speed Ne, first sampling time interval $T_{S1}$, and second sampling time interval $T_{S2}$.

Referring now to FIG. 7, there is shown the second characteristic map showing how first and second sampling time intervals $T_{S1}$ and $T_{S2}$ vary relative to engine speed Ne. The second characteristic map shown in FIG. 7 is slightly different from the first characteristic map shown in FIG. 6, in that in the second characteristic map first sampling time interval $T_{S1}$ is fixed to a predetermined constant value through all engine speeds. That is, a decreasing rate θ1 of first sampling time interval $T_{S1}$ with respect to engine speed Ne is set to "0". On the other hand, as can be appreciated from the second characteristic map of FIG. 7, second sampling time interval $T_{S2}$ tends to reduce in a linear fashion as engine speed Ne increases, and additionally a decreasing rate θ2 of second sampling time interval $T_{S2}$ of the second characteristic map of FIG. 7 is the same as the first characteristic map of FIG. 6. In the second characteristic map of FIG. 7, owing to first sampling time interval $T_{S1}$ fixed constant, arithmetic and logical operations performed within the processor of ECU 19 are somewhat simplified and thus the second characteristic map of FIG. 7 is somewhat superior to the first characteristic map of FIG. 6 in the reduced control load on the continuous variable valve-lift characteristic and phase control system.

Figure 8:
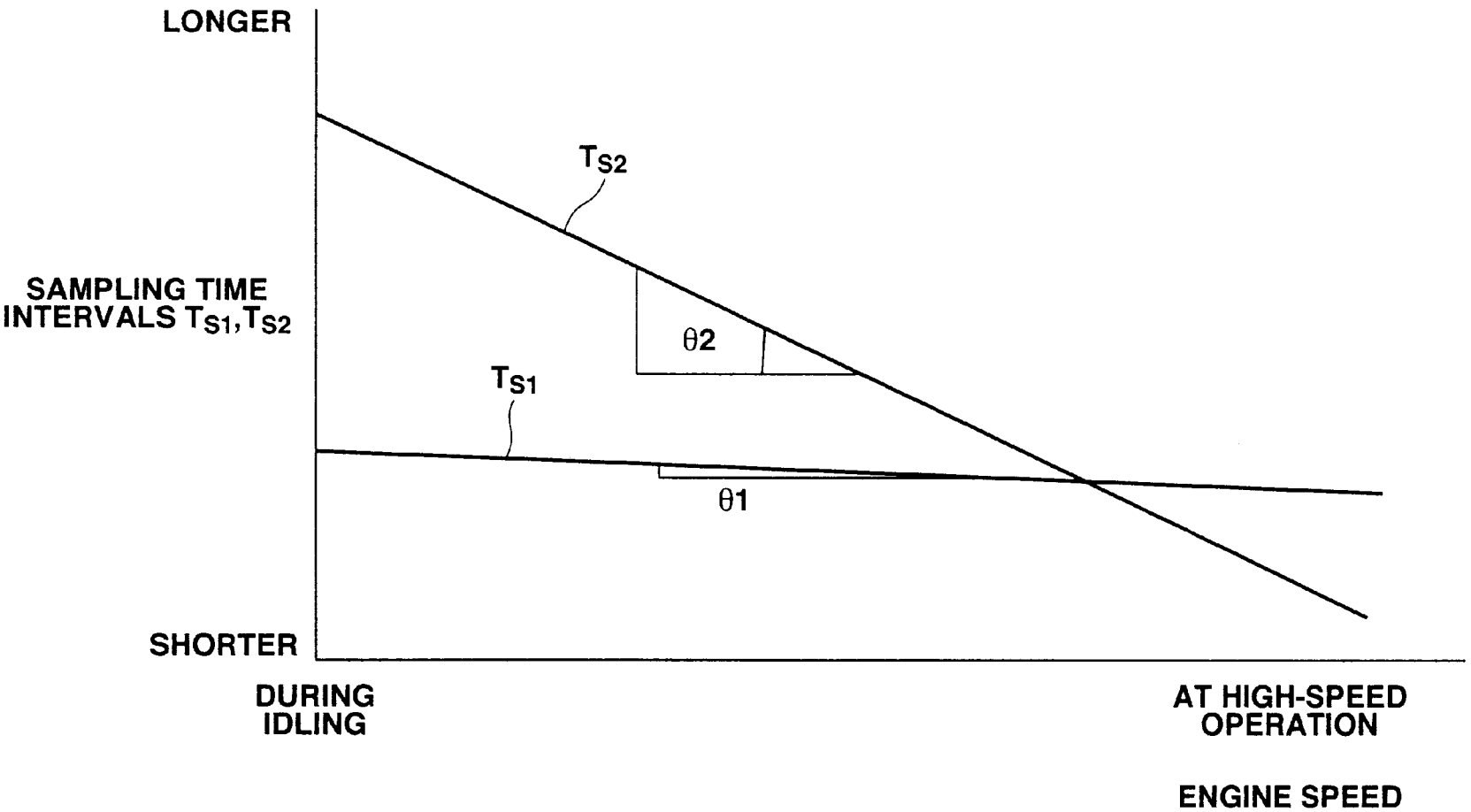
FIG. 8 is a third characteristic map showing the relationship among engine speed Ne, first sampling time interval $T_{S1}$, and second sampling time interval $T_{S2}$.

Referring now to FIG. 8, there is shown the third characteristic map showing how first and second sampling time intervals $T_{S1}$ and $T_{S2}$ vary relative to engine speed Ne. The third characteristic map of FIG. 8 is slightly different from the first characteristic map of FIG. 6, in that a decreasing rate θ2 of second sampling time interval $T_{S2}$ of the third characteristic map shown in FIG. 8 is relatively larger than that of the first characteristic map shown in FIG. 6. On the other hand, a decreasing rate θ1 of first sampling time interval $T_{S1}$ of the third characteristic map of FIG. 8 is the same as the first characteristic map of FIG. 6. That is, the third characteristic map of FIG. 8 is preprogrammed so that the engine speed Ne versus sampling time interval $T_{S1}$ characteristic line and the engine speed Ne versus sampling time interval $T_{S2}$ characteristic line are crossed to each other at a transition point from a middle-speed range to a high-speed range. In other words, in the small and middle speed range second sampling time interval $T_{S2}$ is set to be relatively longer than first sampling time interval $T_{S1}$, while in the high-speed range first sampling time interval $T_{S1}$ is set to be relatively longer than second sampling time interval $T_{S2}$. As discussed previously by reference to the intake valve operating characteristics of FIG. 3, in a high-speed range, the valve lift and working angle of intake valve 11 have to be controlled to comparatively large values. A demand for higher control accuracy that is required to avoid the undesired interference between intake valve 11 and the piston becomes greater in the high-speed range. In other words, at high-speed operation, it is necessary to shorten second sampling time interval $T_{S2}$ of variable phase control mechanism 21. Thus, sampling of the control state of variable phase control mechanism 21 has priority over sampling of the control state of variable lift and working angle control mechanism 1, during high-speed operation. The control state of variable phase control mechanism 21 is thus sampled every relatively shorter sampling time intervals $T_{S2}$ during high-speed operation. This effectively suppresses the control load on the continuous variable valve-lift characteristic and phase control system from increasing undesirably during high-speed operation, and thus reliably avoids the interference between intake valve 11 and the reciprocating piston.

In particular, in variable lift and working angle control mechanism 1 as constructed previously, control shaft 12 tends to rotate in a direction that the valve-lift characteristic changes toward a small lift and working angle, by virtue of a valve-spring reaction force that permanently acts on intake valve 11. Thus, even if the control accuracy is deteriorated due to first sampling time interval $T_{S1}$ adjusted to a comparatively long time interval, a deviation from the desired control state of variable lift and working angle control mechanism 1 tends to be generated in a direction (i.e., in a small-valve-lift direction) that the valve overlap reduces. That is, there is a tendency for the clearance between the piston crown and the valve head portion of intake valve 11 at the top dead center (TDC) position to be increased. In contrast to the above, in variable phase control mechanism 21 as constructed previously, the driving torque acting on drive shaft 2 tends to fluctuate by the valve-spring reaction force, during a comparatively large valve-lift period. For instance, when intake valve 11 moves upwards, the torque acts in the opposite direction to a direction of rotation of drive shaft 2. Conversely when intake valve 11 moves downwards, the torque acts in the same direction as the rotation direction of drive shaft 2. On multiple cylinder engines, torques acting in the opposite rotation directions act as a resultant torque. Thus, even in presence of a control error or deterioration in the control accuracy of variable phase control system, a deviation from the desired control state of variable phase control mechanism 21 is not always generated in a direction (i.e., in a small-valve-lift direction) that the valve overlap reduces. For the reasons set forth above, in particular at high-speed operation that requires a large valve lift, the control accuracy of variable phase control mechanism 21 has to be enhanced by shortening second sampling time interval $T_{S2}$, preferentially rather than the control accuracy of variable lift and working angle control mechanism 1 (see the high-speed range defined by $T_{S2}<T_{S1}$ in FIG. 8).

The entire contents of Japanese Patent Application No. P2001-258913 (filed Aug. 29, 2001) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable valve operating system of an internal combustion engine comprising:

a variable lift and working angle control mechanism that enables both a lift and a working angle of an engine valve to be continuously simultaneously varied depending on engine operating conditions including at least an engine speed;

a variable phase control mechanism that enables a phase at a maximum valve lift point of the engine valve to be varied depending on the engine operating conditions;

a first sensor that detects an actual control state of the variable lift and working angle control mechanism every sampling time intervals $T_{S1}$;

a second sensor that detects an actual control state of the variable phase control mechanism every sampling time intervals $T_{S2}$;

at least one of the sampling time interval $T_{S1}$ for the first sensor and the sampling time interval $T_{S2}$ for the second sensor having a characteristic that the one sampling time interval varies relative to the engine speed; and a rate of change in the sampling time interval $T_{S1}$ for the first sensor with respect to the engine speed being different from a rate of change in the sampling time interval $T_{S2}$ for the second sensor with respect to the engine speed.

2. The variable valve operating system as claimed in claim 1, wherein:

the sampling time interval $T_{S2}$ for the second sensor decreases as the engine speed increases; and the rate of change in the sampling time interval $T_{S2}$ for the second sensor with respect to the engine speed in a direction decreasing of the sampling time interval $T_{S2}$ is set to be larger than the rate of change in the sampling time interval $T_{S1}$ for the first sensor with respect to the engine speed in a direction decreasing of the sampling time interval $T_{S1}$.

3. The variable valve operating system as claimed in claim 1, wherein:

the rate of change in the sampling time interval $T_{S1}$ for the first sensor with respect to the engine speed is 0.

4. The variable valve operating system as claimed in claim 1, wherein:

the sampling time interval $T_{S1}$ for the first sensor is set to be shorter than the sampling time interval $T_{S2}$ for the second sensor during low engine speed operation.

5. The variable valve operating system as claimed in claim 1, wherein:

the sampling time interval $T_{S1}$ for the first sensor is set to be longer than the sampling time interval $T_{S2}$ for the second sensor during high engine speed operation.

6. An internal combustion engine comprising:

a variable lift and working angle control mechanism that enables both a lift and a working angle of an engine valve to be continuously simultaneously varied depending on engine operating conditions including at least an engine speed;

a variable phase control mechanism that enables a phase at a maximum valve lift point of the engine valve to be varied depending on the engine operating conditions;

engine sensors that detect the engine operating conditions;

a first sensor that detects an actual control state of the variable lift and working angle control mechanism every sampling time intervals $T_{S1}$;

a second sensor that detects an actual control state of the variable phase control mechanism every sampling time intervals $T_{S2}$;

a first actuator that provides a motive power to the variable lift and working angle control mechanism;

a second actuator that provides a motive power to the variable phase control mechanism;

a control unit configured to be electronically connected to the engine sensors, the first and second sensors, and the first and second actuators, for feedback-controlling all of the lift, the working angle, and the phase of the engine valve depending on the engine operating conditions; the control unit comprising a data processor programmed to perform the following, (a) calculating a desired control state of the variable lift and working angle control mechanism and a desired control state of the variable phase control mechanism based on the engine operating conditions;

(b) calculating both a set value of a first sensor counter corresponding to the sampling time interval $T_{S1}$ for the first sensor and a set value of a second sensor counter corresponding to the sampling time interval $T_{S2}$ for the second sensor based on the engine speed;

(c) sampling the actual control state of the variable lift and working angle control mechanism each time the set value of the first sensor counter has expired;

(d) sampling the actual control state of the variable phase control mechanism each time the set value of the second sensor counter has expired;

(e) applying an error signal corresponding to a deviation of the actual control state of the variable lift and working angle control mechanism from the desired control state to the first actuator; and (f) applying an error signal corresponding to a deviation of the actual control state of the variable phase control mechanism from the desired control state to the second actuator;

a rate of change in the sampling time interval $T_{S1}$ for the first sensor with respect to the engine speed being different from a rate of change in the sampling time interval $T_{S2}$ for the second sensor with respect to the engine speed.

7. The internal combustion engine as claimed in claim 6, wherein:

the data processor further programmed to perform the following, (g) decreasingly compensating for the sampling time interval $T_{S2}$ for the second sensor as the engine speed increases, so that the rate of change in the sampling time interval $T_{S2}$ for the second sensor with respect to the engine speed in a direction decreasing of the sampling time interval $T_{S2}$ is larger than the rate of change in the sampling time interval $T_{S1}$ for the first sensor with respect to the engine speed in a direction decreasing of the sampling time interval $T_{S1}$.

8. The internal combustion engine as claimed in claim 6, wherein:

the data processor further programmed to perform the following, (h) fixing the sampling time interval $T_{S1}$ for the first sensor to a predetermined constant value irrespective of a change in the engine speed.

9. The internal combustion engine as claimed in claim 6, wherein:

the data processor further programmed to perform the following, (i) compensating for both the sampling time interval $T_{S1}$ for the first sensor and the sampling time interval $T_{S2}$ for the second sensor depending on the engine speed, so that the sampling time interval $T_{S1}$ for the first sensor is shorter than the sampling time interval $T_{S2}$ for the second sensor during low engine speed operation.

10. The internal combustion engine as claimed in claim 6, wherein:

the data processor further programmed to perform the following, (i) compensating for both the sampling time interval $T_{S1}$ for the first sensor and the sampling time interval $T_{S2}$ for the second sensor depending on the engine speed, so that the sampling time interval $T_{S1}$ for the first sensor is set to be longer than the sampling time interval $T_{S2}$ for the second sensor during high engine speed operation.

11. An internal combustion engine comprising:

a variable lift and working angle control means for enabling both a lift and a working angle of an engine valve to be continuously simultaneously varied depending on engine operating conditions including at least an engine speed;

a variable phase control means for enabling a phase at a maximum valve lift point of the engine valve to be varied depending on the engine operating conditions;

engine sensors for detecting the engine operating conditions;

a first sensor for detecting an actual control state of the variable lift and working angle control means every sampling time intervals $T_{S1}$;

a second sensor for detecting an actual control state of the variable phase control means every sampling time intervals $T_{S2}$;

a first actuator for providing a motive power to the variable lift and working angle control means;

a second actuator for providing a motive power to the variable phase control means;

a control unit configured to be electronically connected to the engine sensors, the first and second sensors, and the first and second actuators, for feedback-controlling all of the lift, the working angle, and the phase of the engine valve depending on the engine operating conditions; the control unit comprising a data processor programmed to perform the following, (a) calculating a desired control state of the variable lift and working angle control means and a desired control state of the variable phase control means based on the engine operating conditions;

(b) calculating both a set value of a first sensor counter corresponding to the sampling time interval $T_{S1}$ for the first sensor and a set value of a second sensor counter corresponding to the sampling time interval $T_{S2}$ for the second sensor based on the engine speed;

(c) sampling the actual control state of the variable lift and working angle control means each time a count value of the first sensor counter reaches the set value;

(d) sampling the actual control state of the variable phase control means each time a count value of the second sensor counter reaches the set value;

(e) applying an error signal corresponding to a deviation of the actual control state of the variable lift and working angle control means from the desired control state to the first actuator;

(f) clearing the count value of the first sensor counter after application of the error signal to the first actuator;

(g) applying an error signal corresponding to a deviation of the actual control state of the variable phase control mechanism from the desired control state to the second actuator; and (h) clearing the count value of the second sensor counter after application of the error signal to the second actuator;

a rate of change in the sampling time interval $T_{S1}$ for the first sensor with respect to the engine speed being different from a rate of change in the sampling time interval $T_{S2}$ for the second sensor with respect to the engine speed.

12. The internal combustion engine as claimed in claim 11, wherein:

the data processor further programmed to perform the following, (i) linearly decreasing the sampling time interval $T_{S2}$ for the second sensor as the engine speed increases; and (j) setting the rate of change in the sampling time interval $T_{S2}$ for the second sensor with respect to the engine speed in a direction decreasing of the sampling time interval $T_{S2}$ to a value larger than the rate of change in the sampling time interval $T_{S1}$ for the first sensor with respect to the engine speed in a direction decreasing of the sampling time interval $T_{S1}$.

13. The internal combustion engine as claimed in claim 11, wherein:

the data processor further programmed to perform the following, (i) fixing the sampling time interval $T_{S1}$ for the first sensor to a predetermined constant value irrespective of a change in the engine speed.

14. The internal combustion engine as claimed in claim 11, wherein:

the data processor further programmed to perform the following, (i) compensating for both the sampling time interval $T_{S1}$ for the first sensor and the sampling time interval $T_{S2}$ for the second sensor depending on the engine speed, so that the sampling time interval $T_{S1}$ for the first sensor is shorter than the sampling time interval $T_{S2}$ for the second sensor during low engine speed operation.

15. The internal combustion engine as claimed in claim 12, wherein:

the data processor further programmed to perform the following, (i) compensating for both the sampling time interval $T_{S1}$ for the first sensor and the sampling time interval $T_{S2}$ for the second sensor depending on the engine speed, so that the sampling time interval $T_{S1}$ for the first sensor is set to be longer than the sampling time interval $T_{S2}$ for the second sensor during high engine speed operation.

* * * * *